United States Patent [19]

Reed et al.

[11] 4,124,681

[45] Nov. 7, 1978

[54] PARTICULATE CARBON DISPOSAL BY COMBUSTION

[75] Inventors: Robert D. Reed; Wallace F. Hart; John M. Cegielski, all of Tulsa, Okla.

[73] Assignee: John Zink Company, Tulsa, Okla.

[21] Appl. No.: 824,292

[22] Filed: Aug. 15, 1977

[51] Int. Cl.[2] ..... F23B 5/02

[52] U.S. Cl. ..... 423/210; 432/72; 431/5; 431/173; 422/169

[58] Field of Search ..... 432/72; 431/5, 173; 23/277C; 423/210; 110/213, 216, 264

[56] References Cited

U.S. PATENT DOCUMENTS

| | | | |
|---|---|---|---|
| 3,658,482 | 4/1972 | Evans et al. | 23/277 C |
| 3,817,712 | 6/1974 | Wentworth | 23/277 C |
| 3,887,336 | 6/1975 | Hutchinson et al. | 110/213 |
| 4,052,266 | 10/1977 | Griffith | 431/5 |

*Primary Examiner*—Carroll B. Dority, Jr.
*Attorney, Agent, or Firm*—Head, Johnson & Chafin

[57] ABSTRACT

Apparatus for burning the gaseous and carbon particulate products from a kiln in which carbon is being calcined, including a pair of vertical cylindrical vessels, to which the effluent products of calcining are carried, by means of an input conduit, which enters the first vessel in a tangential manner near the bottom end, so that the gases will circulate circumferentially in a spinning flow inside of the vessel, as they progress upwardly to a outlet near the top of the first vessel, which leaves tangentially, and passes to the second vessel and enters it tangentially. The gases then circulate around the inner wall of the second vessel spin flowing downwardly, where they leave near the bottom to enter the stack. Means are provided on the entrance conduit for injecting combustion air into the inlet conduit prior to entry of the effluent products into the first vessel. Water may be included with the combustion air, if desired, which is sprayed into the combustion air, and mixes with the effluent products causing immediate combustion of the combustible gases, and of the carbon particles.

8 Claims, 10 Drawing Figures

10
12
14
16
18
20
22
23
24
26
28
30
30A
30B
31
32
34
36
40
42
54
58
61
64
70
71
72
73
74
76
3
4
5
6
7
8

PARTICULATE CARBON DISPOSAL BY COMBUSTION

BACKGROUND OF THE INVENTION

1. Field of the Invention

This invention lies in the field of combustion of particulate and gaseous products of the calcining of carbon, such as petroleum, or coal, coke, in a kiln.

2. Description of the Prior Art

In that portion of industry which manufactures devices made of carbon, such as generator brushes and other electrodes, it is required that the carbonaceous material from which the devices are manufactured be "calcined" prior to any manufacturing steps. Basic carbonaceous materials are petroleum and coal coke, as well as other cokes. Coke, as made, contains certain hydrocarbons, as well as appreciable mineral ash such as salts/oxides of Na, Ca, Mg, Fe, K, and other elements. All these foreign materials must be removed from the cokes as far as possible prior to the manufacturing steps. The removal process common to industry is termed "calcining." Calcining is a process in which the raw coke is subjected to a temperature level greater than 2,000F for an adequate period, and within a fired-kiln, to drive the hydrocarbon out of the coke to the greatest possible degree, and also to remove as much of the mineral matter as is possible, and where gases effluent from the kiln are both oxygen-free (reducing), and laden with volatilized hydrocarbon, which has been heat-driven out of the coke.

Because of their hydrocarbon content, and also because of other combustible products, the gases have a considerable calorific value, plus sensible heat, in excess of 2000F. Due to abrasion in the course of passage through the kiln, the gases are also laden with particulate carbon in sizes ranging from less than a micron to hundreds of microns.

SUMMARY OF THE INVENTION

It is a primary object of this invention to provide an apparatus which can burn gaseous and particulate carbon matter which is produced in the calcining of coke made from petroleum or coal, as well as from other similar materials.

The gaseous combustibles burn rapidly and readily when air (as an oxygen supply) is introduced to the gases, to produce very significant quantities of heat, which causes elevation of gaseous temperature in excess of 2,600F. This temperature is excessive and damaging for refractory endurance, and, therefore, it may be required that water spray for simultaneously injected to the combustion zone along with the combustion air, which permits the additional burning, and where the water spray, by heat absorption, controls the ultimate temperature to a level which can be endured by the refractory, and, after vaporization, contributes to carbon partial oxidation via water-gas shift reactions.

Carbon, as a solid, burns almost infinitely more slowly than a gaseous combustible and by surface action only; also as the particle size doubles, the burning time for the carbon particle increases by a factor of 16. Therefore, to assure complete burning of all the particulate carbon, and in view of the almost tremendous particle size range, some means for interception of the largest particles, to prevent their discharge to atmosphere, must be provided. The oxidation (complete or partial burning of the carbon) is by way of a number of high temperature chemistries as:

$$C + O_2 = CO_2;$$

$$C + CO_2 = 2-CO;$$

$$C + H_2O = CO + H_2;$$

$$C + 2-H_2O = CO_2 + 2-H_2$$

It will be observed that the high temperature attack of $H_2O$ on C is very significant. Therefore, the water which is primarily injected as a coolant, and as it is heat-vaporized in cooling, accelerates the oxidation of the particulate, and solid, carbon to greatly improve particulate carbon elimination prior to final venting of gases to the atmosphere through use of all four oxidation chemistries.

This invention is directed to the treatment of gases effluent from a calcining kiln to completely consume all combustibles, from any source, and completely oxidize the particulate carbon of kiln-evolved gases prior to venting of them to the atmosphere; also, to remove from the gas stream any particulate carbon which is too large for oxidation within the system, and prior to discharge to atmosphere. It is to be noted that large particulates, which require such removal, are comparatively rare.

These and other objects are realized and the limitations of the prior art are overcome in this invention by providing at least one, and preferably two, vertical circular cylindrical vessels. These are made of steel and are lined with suitable refractory to handle gases having temperatures up to 2600F. The first of the two vessels is shorter than the second one and contains a conical base to the tank. The inlet conduit leading from the kiln, and carrying the gaseous and particulate combustible material, is also lined with refractory and enters the first vessel tangentially near its bottom end. The gas flows helically inside the tank, as it progresses upwardly in a spinning flow, to a point near the top, where it leaves the first vessel tangentially and enters the second vessel at the top, again tangentially. The gases then follow a helical path or spinning flow downwardly inside of the second vessel, to depart from the second vessel tangentially through an outlet conduit near its bottom end. This conduit can then go directly to a stack, or to a waste heat recovery apparatus, and then to the stack.

The gases reaching the inlet conduit from the kiln are at high temperature and are free of oxygen. Oxygen in the form of air is injected into the inlet conduit from a plenum which surrounds the conduit, through a plurality of short pipes, welded through the wall of the conduit, and circumferentially positioned. Air is supplied under pressure to the plenum and flows through the short pipes, which are directed, in radial planes, downstream of the flow in the conduit, to the first vessel.

Since the temperature of the burning products may be high enough to injure the refractory which lines the inlet conduit and the first and second vessels, means are provided for injecting water sprays into each of the short pipes, so that the combustion air flowing into the inlet conduit from the plenum is mixed with water droplets prior to entry. This water is gauged as to quantity, to maintain a selected maximum temperature of burning inside of the inlet pipe and first vessel; also a maximum of $C + H_2O$ reaction.

Since there may be fairly large particles of carbon and since the particulate carbon burns very slowly, it is desirable to mechanically remove these larger particles. This is accomplished by the helical flow of the burning gases, which throws the particulate matter outwardly against the wall, and causes them to reduce velocity and to fall to the bottom of the first tank. A conical bottom is provided, which terminates in a pool of water which is circulated through a tank beneath a circular opening in the bottom. The particles of carbon are cooled and removed from the tank.

BRIEF DESCRIPTION OF THE DRAWINGS

These and other objects and advantages of this invention and a better understanding of the principles and details of the invention will be evident from the following description taken in connection with the appended drawings in which.

DESCRIPTION OF THE PREFERRED EMBODIMENT

Figures 1, 2:
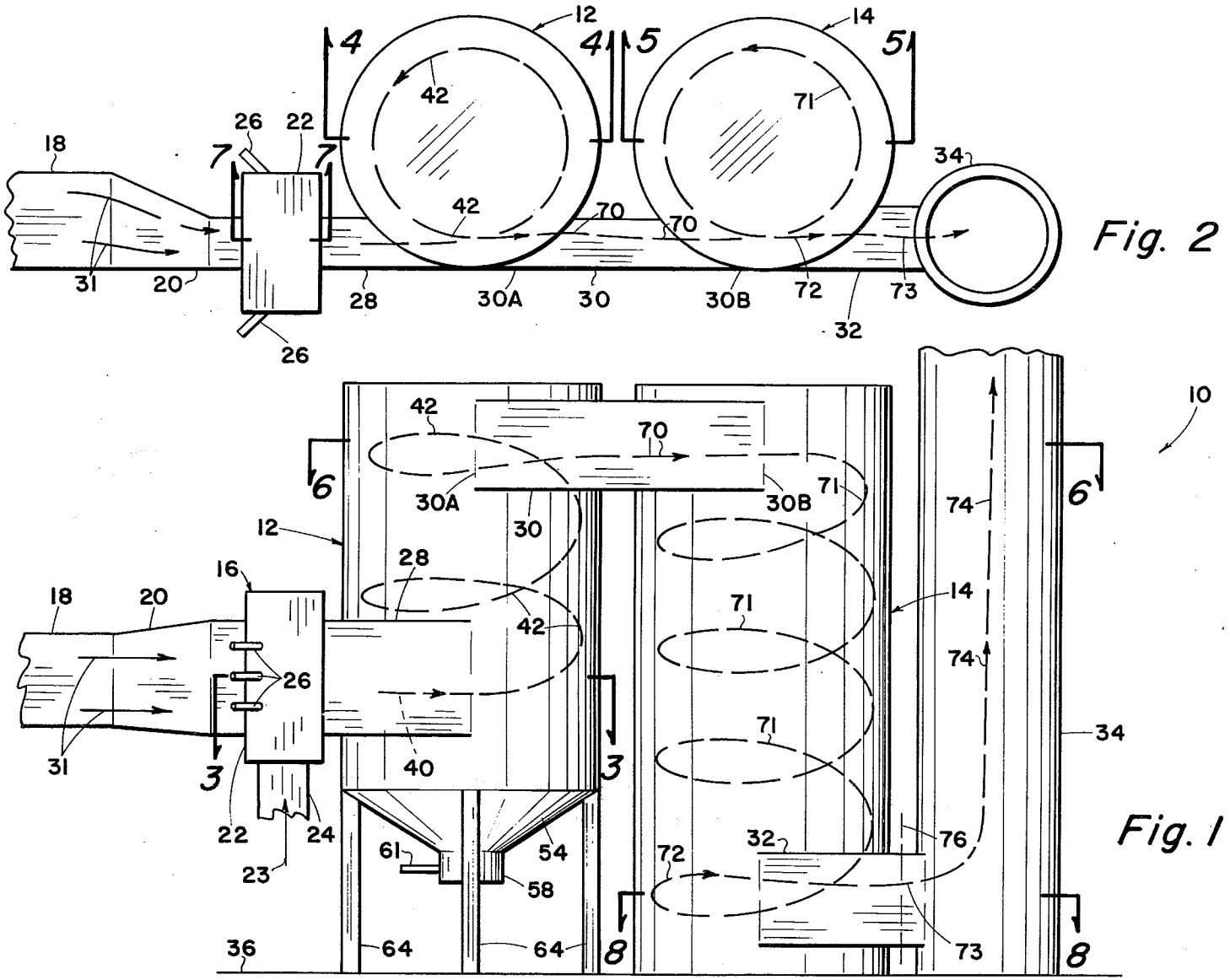
FIGS. 1 and 2 represent in elevation and plan views, respectively, one embodiment of this invention.

Referring now to the drawings and, in particular, to FIGS. 1 and 2, there is shown in elevation and plan, respectively, one embodiment of this invention.

Not shown is a kiln in which coke is being calcined to remove hydrocarbon and other organic matter, and any particles of carbon that may be in small size and formed as a result of abrasions during the operation of the kiln. This gaseous and particulate matter, called effluent products, leaves the kiln as an effluent gas, at very high temperature and is carried to the apparatus of this invention through an inlet conduit of a selected size which is lined with suitable refractory material, as is well known in the art.

The inlet conduit 18 of FIG. 1 connects from the kiln, and by means of a conversion section 20, as may be necessary, enters the inlet conduit 28, to the first of two vessels indicated generally by the numeral 12. The two vessels 12 and 14 are vertical, circular, cylindrical vessels, and as will be described in FIGS. 4 and 5, they are made of steel, and are lined with suitable refractory material to withstand the expected temperatures of up to 2600° F. Prior to entry into the first vessel through conduit 28, the kiln effluent gases or products, pass through a portion of the conduit 28 where oxygen in the form of air is injected under pressure into the effluent gases which are flowing in the conduit 18 in accordance with arrows 31, as shown in FIGS. 1 and 2.

Figure 3:
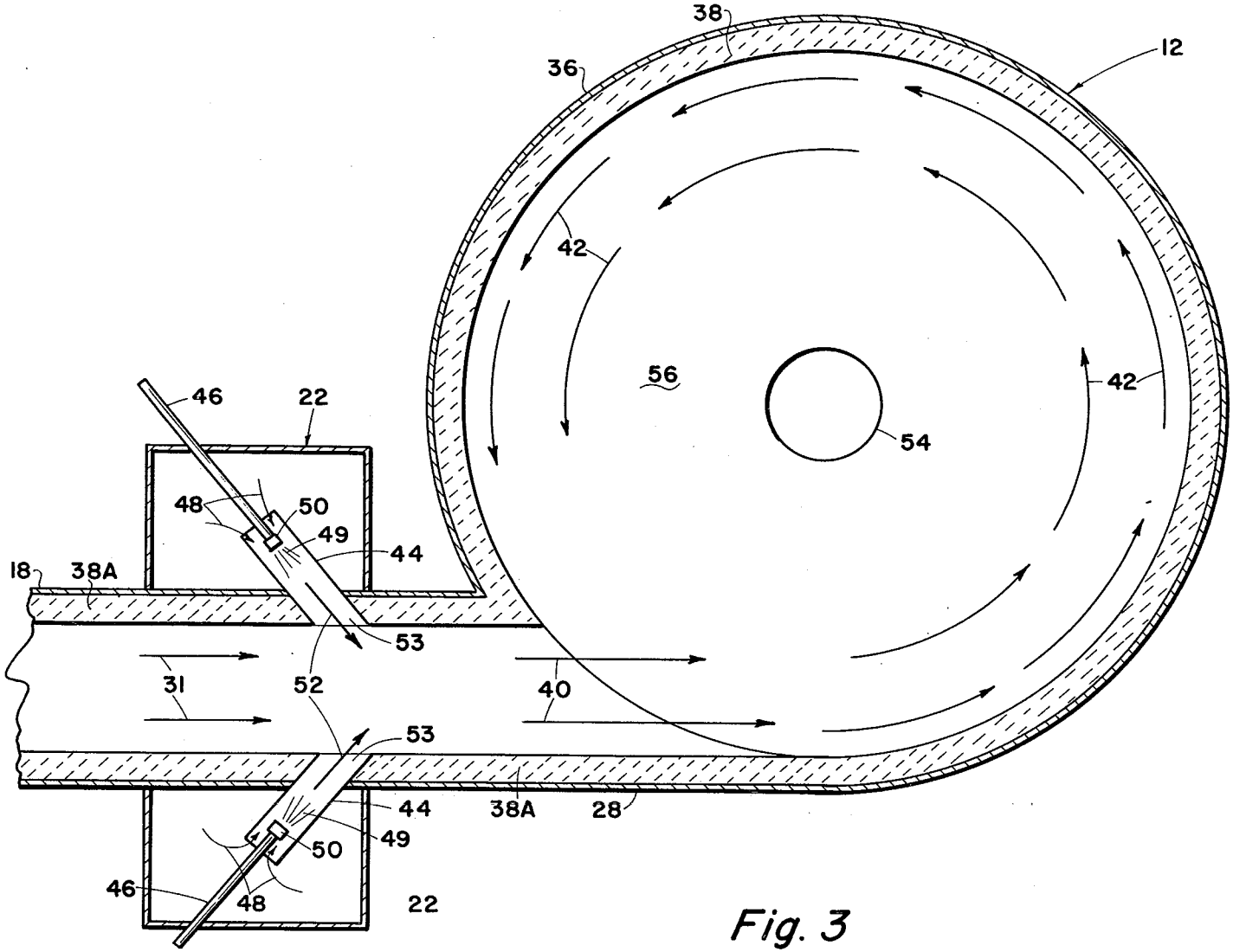
FIG. 3 is a view in vertical cross-section taken across the plane 3—3.

FIG. 3 will fully describe the manner of injecting combustion air into the conduit 28 and also injecting water in the form of a spray with the combustion air. The amount of water injected will be determined by the desired resultant temperature when the oxygen mixes with the effluent gases 31, and they immediately burn and produce a still higher temperature, which may be required to be held down, by means of the water spray.

The mixture of effluent products from the kiln, with air, and water, if necessary, forms a burning mass of gas and hot particles, which flow into the bottom end of the first vessel 12 near the bottom thereof, through conduit 28, and flow in accordance with arrows 40, and 42 in a helical form of flow, or spinning flow, until they reach a point near the top of the first vessel 12 where they leave by a crossover conduit 30, which is tangent at both ends 30A and 30B to the first and second vessels, respectively. Thus, the helically flowing gases from the first vessel 12, flow tangentially and helically into and around the second vessel 14 in accordance with arrows 70 and 71, circularly and downwardly, until near the bottom of the second vessel 14, they flow in accordance with arrow 72 through an outlet conduit, or breeching conduit, 32 into the base of the stack 34, and upwardly in accordance with arrows 74 to the top, and to the atmosphere.

The introduction of air to the effluent products in the conduit 28 causes immediate burning of the gaseous combustible content of the effluent products 31. The quantity of air is selected so that only a small excess air is provided for the burning of the gaseous combustibles and the particulate carbon carried by the effluent gases. The quantity of water injected into the combustion air is selected to provide a heat sink for the combustion caused by the introduction of air, to control the temperature of the gases 40, to a level which can be endured satisfactorily, by the refractory material lining the conduits 18, 20, 28, 30, and 32, as well as the vessels 12 and 14 and the stack 34; also to chemically assist partial oxidation of carbon.

The burning gases, comprising the effluent, plus air and water, are moving tangentially in the first and second vessels. It may be said that the gases are in spinning flow, which causes a throw-out of the larger carbon particles to the area adjacent to the inner face of the refractory in the vessels 12. From that area, since they are no longer suspended in the moving gases, the larger particles fall to the hopper floor 54.

Referring now to FIG. 3, there is shown a cross-sectional view taken along the plane 3—3 of FIG. 1. The entering conduit 18 carries the effluent products 31. This conduit is lined with refractory 38A, and enters the wall of the first vessel 12 in a tangential manner as shown.

There is a plenum 22 which surrounds the conduit 18, which has a plurality of circumferentially spaced openings 53 into which short pipes 44 are inserted. Means, as shown in FIGS. 1 and 3, are provided, including an entry conduit 24 for the flow of air 23 from a compressor means, not shown. Inside the plenum 22 the air flows in accordance with arrows 48 into the short pipes 44, and in accordance with the arrows 52 downstreamwise into the conduit 28, where the air mixes with the hot effluent gases 31, to initiate immediate combustion in the form of flame 40 moving into the vessel 12. If the temperature inside the conduit 28 and the vessel 12 is too high, also as acceleration of carbon partial oxidation is required, water is injected through pipes 46 and through nozzles 50 in each of the pipes 44, so that a spray of water 49 will be carried in the form of fine droplets with the air into the flame 40, so as to maintain a maximum temperature commensurate with the type of refractory 38 which lines the conduit 18 and the vessel 12; also vaporization of injected liquid water for high-temperature carbon attack.

Figure 4A:
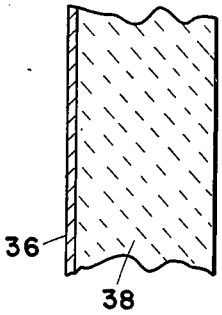
FIGS. 4 and 5 show, in vertical cross-sections, views of the first and second vessels.
Figure 4:
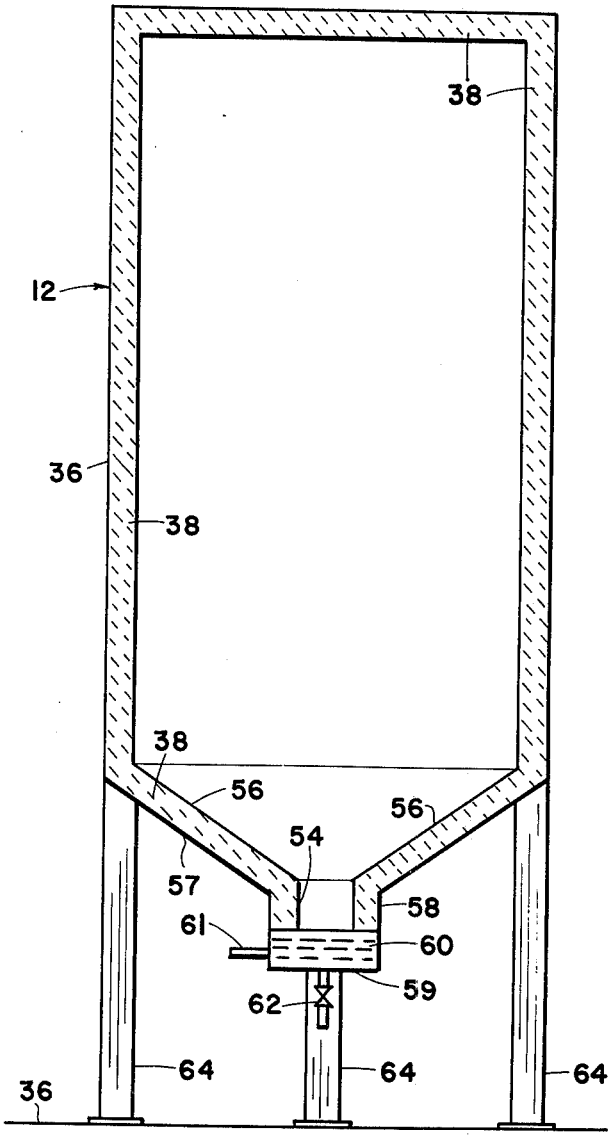

Referring now to FIGS. 4 and 4A, there is shown in cross-section taken across a plane 4—4 of FIG. 2, the vessel 12. This vessel is made of a cylindrical steel plate 36 with a lining 38 of suitable refractory, as is well known in the art. There is a sloping conical floor 57 to the tank, which is lined with refractory to provide an upper surface 56.

Due to the spinning flow of flame, upwardly in the vessel 12, any particles of mass greater than a selected value, dependent upon the flow velocity of the flame and gas, will be thrown outwardly against the wall, and will be slowed down to the point where they will drop to the floor 56 and roll down into the opening 54. The bottom portion of the conical floor is a circular cup-like tank 58, which is partially filled with water which enters through a pipe 61 and leaves by means of a pipe and valve 62, so that cold water can be circulated to cool the particles of carbon that fall into the opening 54. Means are provided, not shown, but well known in the art, for removing the particles of carbon which collect in the tank 58, on top of the bottom plate 59.

The tank is supported on the surface of the surface of the earth 36 by legs 64 or other means well known in the art, so as to make available, space under the vessel for collection of the carbon, supply of water, etc.

Figure 5:
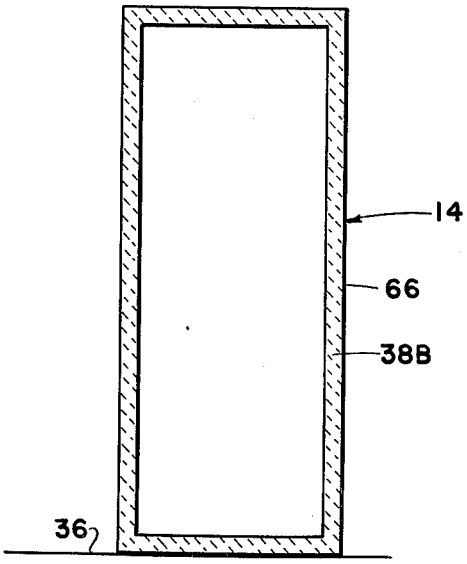
Figure 5A:
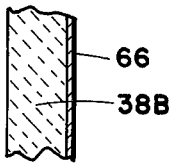

Shown in FIG. 5 is a view in cross-section taken along plane 5—5 of FIG. 2, which shows the construction of the second vessel 14 which is similar in general construction to that of vessel 12, except that, since it has no particulate collection apparatus, it has a plain horizontal bottom closure, is longer, and is adapted to rest on the grade 36.

The entry of a hot gas and flame to the inlet conduit 28 tangentially to vessel 12, and to the crossover conduit 30, from the top of the first vessel to the top of the second vessel and then down helically to the tangential conduit 32, provides a longer period of residence of the flame inside the hot interior of the two vessels.

In certain cases it may be practical to eliminate the second vessel if there is sufficient residence time in the first vessel, to completely burn all of the gaseous components of the effluent gas, and all of the finer particulate matter that will not be collected in the bottom of the first vessel. If all the particulate matter can be eliminated during the residence time in the first vessel, the conduit 30 can go directly to the stack in a manner similar to the outlet conduit 32 shown in FIG. 1.

More generally, however, it would be desirable to have two vessels, so that a residence time at least twice as long can be provided, to insure complete combustion of all combustible matter in the effluent gas from the kiln. The use of a second vessel 14 provides the outlet 32 at a point near the base of the second vessel, so that if it is decided to use a conventional waste heat recovery means, it can be inserted into the outlet conduit 32 at a plane such as at 76 in series between the second vessel and the base of the stack.

Figure 6:
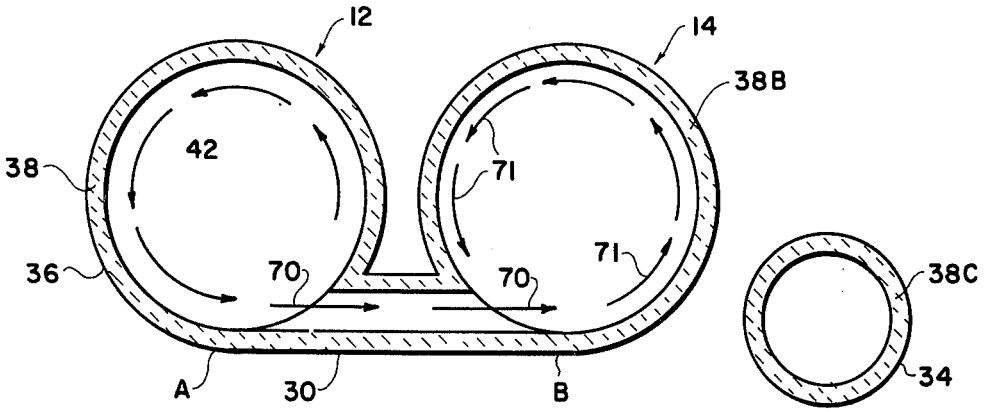
FIGS. 6, 7 and 8 show, in cross-section, views taken, respectively, across plane 6—6 of FIG. 1, plane 7—7 of FIG. 2, and plane 8—8 of FIG. 1.

Referring now to FIG. 6, there is shown a cross-section, taken along the plane 6—6 of FIG. 1, which illustrates the flow of gas and flame 42 upwardly, and in a counter-clockwise direction, in the first vessel 12, and out through the crossover conduit 30, in accordance with arrow 70, then downwardly in a helical flow inside of the second vessel 14 in accordance with arrow 71.

Figure 7:
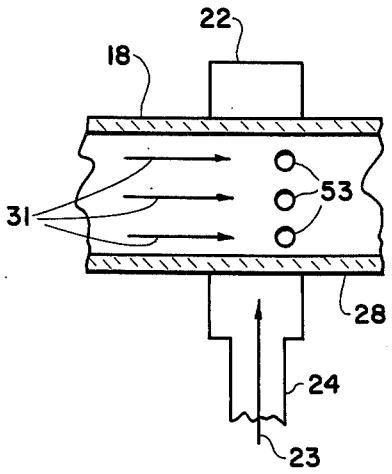

FIG. 7 illustrates a cross-section taken along the plane 7—7 of FIG. 2 which shows the entrance conduit 18 and 28, with the plenum 22 surrounding the conduit 28. The effluent products are indicated by arrows 31. The openings 53 are for the combustion air and the water droplets. The combustion of air enters the plenum through pipe 24 in accordance with arrow 23.

Figure 8:
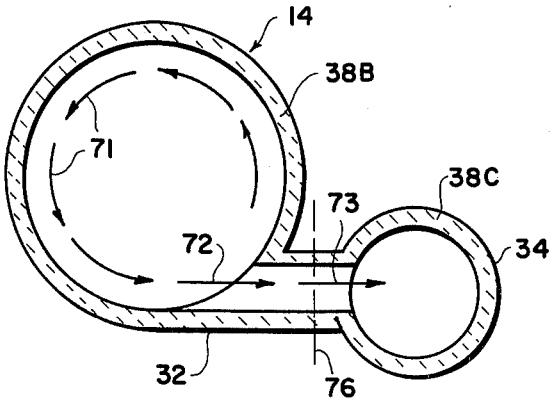

FIG. 8 illustrates a cross-section taken across the plane 8—8 in FIG. 1, which shows the second vessel 14, and the outlet conduit 32, leading to the base of the stack 34. As shown, the vessel 14, the outlet conduit 32, and the stack are all lined with refractory indicated as 38B and 38C. The helically flowing, or spinning flow, of hot gas in the vessel 14 is indicated by the arrows 71, which when they reach the bottom of the vessel leave by the breeching or outlet conduit 32, in accordance with arrow 72, and enter the base of the stack 34 in accordance with arrow 73.

If, as is expected to be the case, a waste heat recovery system is utilized, the outlet conduit 32 of the second vessel 14 makes it convenient to install the waste heat recovery apparatus at grade level 36, along the plane 76, and would then lead into the base of the stack 34.

Gases as they reach the stack are at a high temperature level and contain a very significant quantity of heat which is subject to recovery through a number of means for energy conservation. While this is outside of the area of interest of this invention, it is clear that the use of the second spinning vessel 14, with its downward gas movement, brings the gases for stack discharge down to a level with respect to grade, which will readily allow installation and use of future heat recovery apparatus at grade level, and at minimum difficulty and expense.

It is commonly known the increase in temperature results in greatly increased rate of chemical reaction. Attack of oxygen on any combustible is by virtue of chemical reaction, and this includes gaseous hydrocarbons, etc., as well as the coke particulates. Therefore, it is desirable to obtain temperature increase as soon as possible, as gases enter and pass through the system for oxidation of combustible components. In the system of this invention the effluent gases commence burning immediately that the combustion air mixes with the effluent at the outlet of the openings 53. Thus, there is a controlled temperature increase in the entrance conduit and in the first vessel 12 at the very beginning of the system. Thus, the temperature level for the entire gas passage within the system is at a higher temperature level than at the exit from the kiln, and particulate burning is greatly accelerated, and less residence time within the system is required for complete burning of particulate carbon, which is an end sought in the operation of the system. Note also, that, the choice of spinning, or tangential, gas movement in the first spinning vessel 12 and second spinning vessel 14, greatly enhances the resident time for gases in passage through the system, where the system is of finite total length, and at any gas movement velocity. That is, the spiral route, as compared to the direct route, where the spiral route is much longer than the direct route.

In all burning, a finite burning time is required and burning time can be considered as residence time. Therefore, the tangentially moving gases can provide a much more compact system than would be the case for direct gas flow.

What has been described is an improved system for the combustion of effluent products from a carbon calcining operation, which includes hydrocarbon and other gases, and fine particulate carbon. The system is physically and thermally specially arranged, and has an entry means for the effluent gases from the kiln, into which are provided means for simultaneous injection of combustion air plus a water spray of fine droplets, immediately prior to entry of the effluent gases into the first spinning vessel. They then travel tangentially across to the top of the second spinning vessel, and thence by the breeching conduit to a stack, for ultimate venting to the atmosphere as a particulate carbon-free final gas.

Because of the spinning action in the first vessel, the larger particulate matter is thrown out of the gas and is collected and cooled at the bottom of the first spinning vessel. By the use of a second spinning vessel the flowing gases are provided with greater residence time to complete the combustion, and to bring the gas stream down to a point near grade level where, as desired, a conventional type of waste heat recovery means can be used to recover the sensible heat of the gases before entry into the stack.

While the invention has been described with a particular degree of particularity, it is manifest that many changes may be made in the details of construction and the arrangement of components. It is understood that the invention is not to be limited to the specific language used or the specific embodiment set forth herein by way of exemplifying the invention, but the invention is to be limited only by the scope of the attached claims, including the full range of equivalency to which each element or set thereof is entitled.

What is claimed is:

1. Apparatus for combustion of gaseous and particulate effluent products from a kiln, in which carbon is being calcined, comprising;

(a) at least a first cylindrical vessel lined with refractory, and means for entry of said products tangentially, at a first end, through a refractory-lined inlet conduit from said kiln;

(b) means for injecting air under pressure into said inlet conduit upstream of said vessel;

(c) means for injecting water spray into said air; prior to entry into said inlet conduit;

(d) tangential conduit means connected to the second end of said first vessel to carry the products of combustion of said effluent products to a stack, and to the atmosphere.

2. The apparatus as in claim 1, including a second cylindrical vessel, in which both said first and second vessels have axes vertical, and in which said first end of said first vessel is the bottom end;

said tangential conduit means connecting the top end of said first vessel tangentially to the top of said second vessel;

the bottom end of said second vessel connected to said stack through an outlet conduit whereby said products of combustion enter tangentially the top of said second vessel from the top of said first vessel, flow helically downwardly in said second vessel, and leave tangentially the bottom of said second vessel to be carried to said stack.

3. The apparatus as in claim 1 in which said means to inject air into said conduit comprises;

(a) air plenum means surrounding said inlet conduit;

(b) means to supply air under pressure to said plenum; and (c) a plurality of circumferentially spaced short pipes entering said inlet conduit from said plenum, and directed downstream of the flow in said inlet conduit.

4. The apparatus as in claim 3 including means to inject water spray into each of said short pipes.

5. The apparatus as in claim 2 including refractory lining in each of said;

inlet conduit,
first vessel,
tangential conduit means,
second vessel,
outlet conduit, and
stack.

6. The method of burning hot gaseous and particulate products from a kiln, in which carbon is being calcined, said hot gaseous and particulate products passing into a refractory lined inlet conduit, comprising;

(a) injecting air under pressure into said inlet conduit;

(b) injecting sprays of water droplets with said air into said inlet conduit; where said air and water mix with said hot gaseous and particulate products, which burn;

(c) discharging said burning hot products tangentially into at least a first vertical cylindrical vessel at the bottom end;

(d) passing said burning hot products along a helical path upwardly in said vessel, whereby said particulate matter will be thrown outwardly against the wall of said vessel, and will fall to the bottom;

(e) collecting the particulate matter at the bottom of said vessel; and (f) discharging the burned hot gases from the top of said at least one vessel.

7. The method as in claim 6 including the additional steps of:

(a) discharging said hot gases from the top of said at least one vessel tangentially into the top of a second vertical cylindrical vessel; and (b) discharging said hot gases from the bottom of said second vessel.

8. The method as in claim 7, including the additional steps of:

(a) discharging said hot gases from the bottom of said second vessel to a waste heat collecting means; and (b) discharging the cooled said hot gases from said waste heat collecting means to the stack.

* * * * *